US008622380B2

(12) United States Patent
Yamazaki et al.

(10) Patent No.: US 8,622,380 B2
(45) Date of Patent: Jan. 7, 2014

(54) SHEET FEEDING DEVICE AND IMAGE FORMING APPARATUS

(71) Applicant: Canon Kabushiki Kaisha, Tokyo (JP)

(72) Inventors: Yoshitaka Yamazaki, Abiko (JP); Yuzo Matsumoto, Abiko (JP); Tetsuro Fukusaka, Abiko (JP); Taishi Tomii, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/752,072

(22) Filed: Jan. 28, 2013

(65) Prior Publication Data

US 2013/0193633 A1 Aug. 1, 2013

(30) Foreign Application Priority Data

Jan. 31, 2012 (JP) ..... 2012-018449

(51) Int. Cl.
*B65H 3/14* (2006.01)

(52) U.S. Cl.
USPC ..... 271/97; 271/98; 271/96; 271/108

(58) Field of Classification Search
USPC ..... 271/108, 97, 98, 96, 94, 12, 104
See application file for complete search history.

(56) References Cited

U.S. PATENT DOCUMENTS 4,451,028 A * 5/1984 Holmes et al. ..... 271/11
5,707,056 A * 1/1998 Rauen et al. ..... 271/96
5,785,311 A * 7/1998 Doery ..... 271/110
6,244,586 B1 * 6/2001 Gauger et al. ..... 271/12
6,402,134 B1 * 6/2002 Gauger et al. ..... 271/12
6,439,565 B2 * 8/2002 Gauger et al. ..... 271/12
7,007,940 B2 * 3/2006 Polidoro et al. ..... 271/3.11
7,007,942 B1 * 3/2006 Stearns et al. ..... 271/11
7,575,231 B2 8/2009 Sasaki
8,439,349 B2 * 5/2013 Matsumoto et al. ..... 271/97
8,500,114 B2 * 8/2013 Matsumoto et al. ..... 271/97
2013/0026698 A1 * 1/2013 Ikeuchi et al. ..... 271/11

FOREIGN PATENT DOCUMENTS

JP 06009083 A * 1/1994
JP 11-217148 A 8/1999

* cited by examiner

*Primary Examiner* — Luis A Gonzalez
(74) *Attorney, Agent, or Firm* — Canon U.S.A., Inc., IP Division

(57) ABSTRACT

A sheet feeding device includes drawing and conveying a sheet, applying negative pressure for sheet suction via a suction opening, moving a shutter member between a closing position where the suction opening in an upstream side in a sheet feeding direction is partially closed and an open position where the suction opening is opened, and controlling the shutter member to follow a preceding sheet that is drawn onto the suction conveyance member to move to the downstream side in the feeding direction to close the suction opening, and return to an open position at a predetermined timing to draw the sheets onto the suction conveyance member in a state where an upstream edge of the preceding sheet in the feeding direction and a downstream edge of the subsequent sheet in the feeding direction are overlaid by a predetermined amount.

10 Claims, 11 Drawing Sheets

SHEET FEEDING DEVICE AND IMAGE FORMING APPARATUS

BACKGROUND OF THE INVENTION

1. Field of the Invention

Aspects of the present invention generally relate to a sheet feeding device and an image forming apparatus, and specifically to a device that separates and feeds sheets by blowing an air to the sheets.

2. Description of the Related Art

In the related art, an image forming apparatus, such as a printer or a copying machine, includes a sheet feeding device that feeds sheets one by one loaded in a tray that supports a plurality of sheets. As the sheet feeding device, an air feeding method is known that blows air to an edge of a sheet bundle supported in the tray to float a plurality of sheets while loosening the sheets, and draws the sheet onto a suction conveyance belt disposed at the upper side to feed the sheet one by one. This technology has been discussed in U.S. Pat. No. 7,575,231.

In the meantime, a conveying method is discussed that separately conveys sheets one by one at a predetermined interval by a sheet feeding unit, while partially overlaying the sheets being conveyed. In this conveying method, the sheets are continuously conveyed by a conveyance belt and fallen at the downstream side of the conveyance belt. A delivery belt and a pressing roller are provided in an apparatus employing this conveyance method. The delivery belt receives and further conveys the fallen sheets. The pressing roller presses a leading edge of the sheet which is inclined between the conveyance belt and delivery belt.

In the conveying method that uses these belts, the delivery belt is driven at a sufficiently slower speed than the conveyance belt. Therefore, a sheet is conveyed in a state where a trailing edge of a preceding sheet is hanging on the conveyance while a leading edge thereof is hanging on the delivery belt such that a leading edge of a subsequent sheet is overlaid with the trailing edge of the preceding sheet. This technology is discussed in Japanese Patent Application Laid-Open No. 11-217148.

As described above, since the sheets are conveyed to overlay with each other in a stable state owing to the pressing roller that presses the leading edge of the sheet, it is possible to increase a conveyance amount of sheets in a unit time without increasing a driving speed of the roller or the belt in a conveyance path. Further, by suppressing the driving speed to be low, it is further possible to satisfy a certain performance even when a small size and low speed actuator is used as a driving source. Therefore, it is possible to suppress the increase in the cost, an operation noise, and power consumption to be low even when the actuator is driven at a high speed.

However, when the feeding unit of the air feeding method in the related art and a conveyance unit that conveys sheets to overlay with each other are combined, after separately delivering the sheets one by one from the feeding unit, the conveyance unit conveys sheets in an overlaid state to improve productivity. In this case, in order to improve the productivity by increasing a conveyance amount of the sheets, even though the conveyance amount of sheets is increased by the overlay conveyance in the conveyance unit, a feeding speed in the feeding unit that delivers the sheet to the conveyance unit goes up in proportion to a quantity of production. Therefore this method may not contribute to the lowering of the speed.

If a mechanism which conveys the sheets by the air feeding method while overlaying with each other is provided in the conveyance path, a size of the entire sheet feeding device becomes larger. Further, in order to perform overlay conveyance, two conveying speeds need to be provided, which may make apparatus control complicated.

SUMMARY OF THE INVENTION

According to aspects of the present invention, a sheet feeding device and an image forming apparatus are capable of reducing a feeding speed without lowering a production quantity of sheets with a simple configuration and improving sheet conveying efficiency while the sheets are fed to overlay with each other by an air feeding method.

According to an aspect of the present invention, a sheet feeding device includes an elevatable tray that supports a sheet, an air blowing unit that blows air toward the sheet supported by the tray to float the sheet, a suction conveyance member that draws and conveys the sheet floated by driving the air blowing unit, a negative pressure generation part that has a suction opening that applies a negative pressure for sheet suction to the suction conveyance member, a shutter member that moves between a closing position where the suction opening in an upstream side in the sheet feeding direction is partially closed and an open position where the suction opening is opened, and a controlling unit that is, in a driving state of the negative pressure generation part, configured to control the shutter member to follow a preceding sheet that is drawn onto the suction conveyance member, to move to a downstream side in the feeding direction to close the suction opening, and return to the open position at a predetermined timing to draw the sheets onto the suction conveyance member in a state where an upstream edge of the preceding sheet in the feeding direction and a downstream edge of the subsequent sheet in the feeding direction are overlaid by a predetermined amount in a driving state of the negative pressure generation part.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
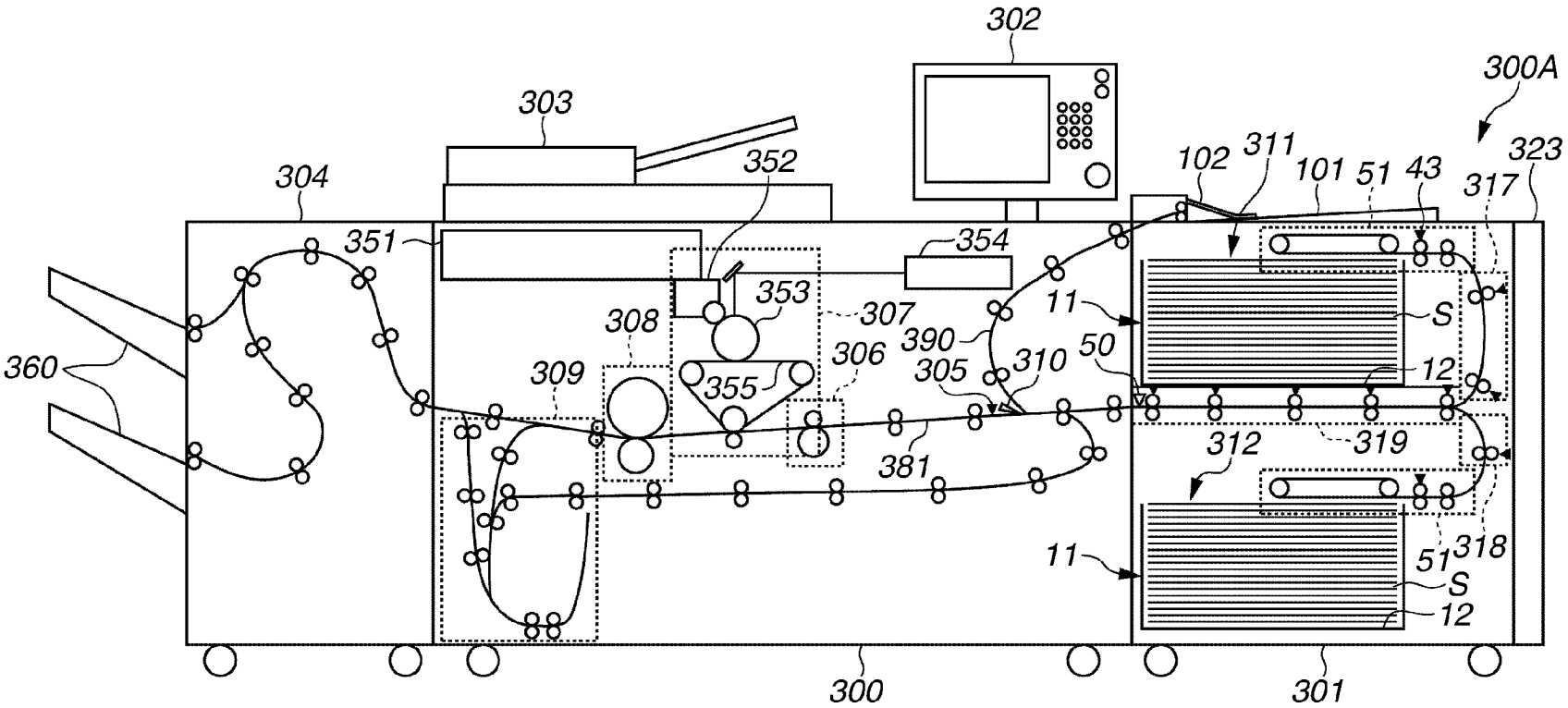
FIG. 1 is a schematic configuration view of an image forming apparatus including a sheet feeding device according to an exemplary embodiment of the present invention.

FIG. 1 is a schematic configuration view of an image forming apparatus including a sheet feeding device according to an exemplary embodiment of the present invention. In FIG. 1, an image forming apparatus 300A includes a main body 300 of the image forming apparatus (hereinafter, referred to as main body), a manipulation part 302, a sheet feeding unit 301, and a sheet processing device 304. Processing such as feeding and conveying a sheet, forming an image, or stapling is performed based on a sheet processing setting set in the manipulation part 302 or an external host PC which is not illustrated by a user and image information transmitted from a reader scanner 303 or the external PC.

The sheet feeding unit 301 includes first and second sheet feeding devices 311 and 312 at upper and lower sides. In the sheet feeding devices 311 and 312, sheet storages 11 and 11 that store a sheet bundle and suction conveyance mechanisms 51 and 51 that feed the sheets stored in the sheet storages 11 and 11 are provided. In this exemplary embodiment, the suction conveyance mechanisms 51 and 51 use an air feeding method and feed the sheet while an endless belt is drawing the sheet at the time of a sheet feeding operation.

Here, the sheet feeding unit 301 sequentially feeds and conveys the sheets in each of the sheet storages 11 and 11 in an overlaid state according to sheet request information from the main body 300. Further, the sheet feeding unit 301 conveys a leading sheet to a conveyance sensor 50 which is disposed in a transfer part transferring a sheet to the image forming apparatus 300A. The sheet feeding unit 301 notifies the main body 300 that sheet delivery is ready after the conveyance is completed.

The main body 300 receives the notification that delivery is ready, from the sheet feeding unit 301 and notifies a delivery request to the sheet feeding unit 301. The sheet feeding unit 301 sequentially conveys the overlaid sheets to the main body 300 for every notification of the delivery request. In this case, a sheet conveying speed in the main body 300 is two times or higher than that in the sheet feeding unit 301. The main body 300 separately draws sheets from the sheet feeding unit 301 so as to separate the sheets one by one to sequentially form an image.

At a time when a leading edge of the sheet delivered from the sheet feeding unit 301 reaches a conveyance roller nip disposed at a most upstream side of the main body 300, the sheets are separately drawn by the conveyance roller of the main body 300 one by one and discharged. The sheet feeding unit 301 completes the feeding operation at a time when the number of overlaid sheets requested by the main body 300 is fed and conveyed. The sheet feeding unit 301 completes the operation and enters a stand-by state after separately drawing and discharging the overlaid sheet group by the main body 300.

The sheet conveyed by the suction conveyance mechanism 51 of the first sheet feeding device 311 is fed to the main body 300 through a first conveyance part 317 and a joint conveyance part 319. The sheet conveyed by the suction conveyance mechanism 51 of the second sheet feeding device 312 is fed to the main body 300 through a lower conveyance part 318 and the joint conveyance part 319. A conveyance stepping motor (not illustrated) is provided in each of the conveyance parts 317 to 319 and a conveyance control part (not illustrated) controls the motors to rotate the conveyance roller of each of the conveyance parts to feed the sheet. The driving of the stepping motor of each of the conveyance parts is mechanically transmitted to rotate the conveyance roller of each part to convey the sheet.

On a top surface of the sheet feeding unit 301, an escape tray 101 that forcibly discharges a sheet in an abnormal state caused by double feeding or jam is disposed. A full load detection sensor 102 is provided to detect a full load of the sheet discharged to the escape tray 101. Further, a plurality of displacement sensors is provided for a pair of rollers on the conveyance path of the sheet feeding unit 301 to detect the passage of the leading edge and the trailing edge of the sheet on the conveyance path.

A switching member 310 operates to select a conveyance path 390 leading to the escape tray 101 when the abnormal state of the sheet is detected and operates to select a conveyance path 381 leading to an image forming part 307 when a sheet is in a normal state. When the sheet is in the abnormal state, the sheet S is discharged to the escape tray 101. In contrast, when the sheet is in the normal state, an image forming operation is performed based on image data received by the image forming part 307 from when the sheet is detected by an image reference sensor 305.

A feeding operation is performed by the suction conveyance mechanisms 51 and 51 provided in each of the feeding units. A plurality of fans, which will be described below, is provided in the suction conveyance mechanisms 51 and 51 to control the sheet air-feeding. At the time of the feeding operation of the suction conveyance mechanisms 51 and 51, the fan is controlled to blow air between the sheets S in the sheet storages 11 and 11 from the downstream side of the conveying direction.

When the sheets S are loosened, the sheets are drawn to a suction conveyance belt 21 by the suction from a suction opening 34*a*. The suction opening 34*a* is disposed inside the suction conveyance belt 21, which has an endless belt shape as will be described below. Sheets are fed and conveyed while a part of a preceding sheet is overlaid with a part of a subsequent sheet. The suction conveyance belt 21 constitutes a suction conveyance member that draws the sheet S floated by driving of an air blowing unit 29 to convey the sheet. Details of the overlay conveying operation of the suction conveyance mechanisms 51 and 51 will be discussed below.

The main body 300 forms an image on the sheet S fed by the sheet feeding unit 301. On the top surface of the main body 300, the manipulation part 302 is provided to allow the user to set an operation of the image forming apparatus 300A (image forming system). Further, a reader scanner 303 is disposed above the main body 300 to read an original image. The main body 300 includes the image forming part (sheet processing part) 307 which serves as an image forming unit. The image forming unit includes a photosensitive drum 353, a laser scanner unit 354, a development part 352, and an intermediate transfer belt 355, a fixing part 308, and a reversing conveyance part 309.

In the main body 300, after receiving the sheet from the sheet feeding unit 301, the conveyance part is controlled to convey the sheet. The image forming part 307 performs the image forming operation based on the received image data from when the image reference sensor 305 detects the sheet.

At the time of image forming operation, if the image reference sensor 305 detects the sheet, a semiconductor laser (not illustrated) in the laser scanner unit 354 is controlled to be turned on/off and also the intensity of the semiconductor laser is controlled. Further, the scanner motor that controls a polygon mirror (not illustrated) to be rotated is subjected to control. Thus, the laser light is radiated on the photosensitive drum 353 based on the image data and a latent image is formed on the photosensitive drum 353.

Next, in the development part 352, toner is fed from a toner bottle 351 to develop the latent image on the photosensitive drum 353 and the developed toner image is primarily transferred onto the intermediate transfer belt 355 from the photosensitive drum 353.

Thereafter, the toner image which is transferred onto the intermediate transfer belt 355 is secondarily transferred onto the sheet to form a toner image on the sheet. Just before the secondary transfer position, a registration control part 306 is provided. The registration control part 306 corrects a skew of the sheet which is placed just before the transfer position. Further, the registration control part 306 controls the sheet conveyance to minutely adjust the toner image formed on the intermediate transfer belt 355 and a position of the leading edge of the sheet to match with each other without stopping the sheet.

Next, after the secondary transferring, the sheet is conveyed to the fixing part 308, where heat and pressure are applied to the toner to be fixed on the sheet. Further, after the fixing, if the image is continuously printed (formed) on a rear surface of the sheet or the front and rear surfaces of the sheet are inversed, the sheet is conveyed to the reversing conveyance part 309. Further, when the printing is completed, the sheet is conveyed to the sheet processing device 304 at the downstream side.

The sheet processing device 304 is connected to the downstream side of the image forming apparatus 300A to perform desired processing (bending, stapling, or punching) set in the manipulation part 302 by the user on the sheet discharged from the main body 300, on which the image is formed. Thereafter, the sheets are sequentially output to any one of discharging trays 360 as a resultant to be provided to the user. The sheet processing device 304 constitutes a sheet processing part which is a post-processing part that performs post processing on the sheet on which the image is formed.

Figure 2:
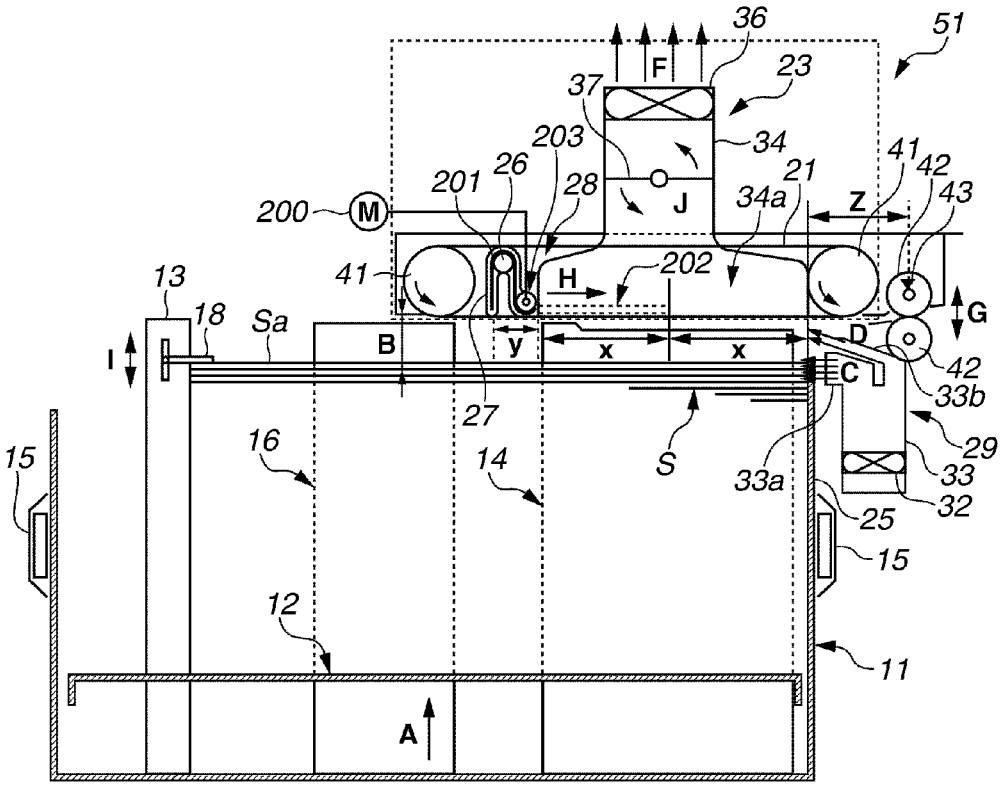
FIG. 2 is a cross-sectional view illustrating a configuration of a second sheet feeding device in a sheet feeding unit of the image forming apparatus.

Next, a schematic configuration of the first and second feeding devices 311 and 312 of the sheet feeding unit 301 according to an exemplary embodiment of the present invention will be described with reference to FIG. 2. FIG. 2 is a view illustrating a configuration of the second sheet feeding device 312 in the sheet feeding unit 301. The first sheet feeding device 311 has a configuration similar to the second sheet feeding device 312. Therefore, the description of the configuration of the first sheet feeding device 311 may be substituted by the description of the second sheet feeding device 312.

As illustrated in FIG. 2, the sheet storage 11 disposed in the second sheet feeding device 312 has a tray 12 on which a plurality of sheets S is loaded (that is, the tray 12 is elevatable while supporting the sheets S). The sheet storage 11 has a trailing edge regulating plate 13 that regulates a trailing edge which is disposed at an upstream edge in a sheet feeding direction (a horizontal direction of FIG. 2). The sheet storage 11 has a leading edge regulating plate 25 that regulates a leading edge which is disposed at a downstream edge on a sheet feeding direction of the sheet S and side edge regulating plates 14 and 16 that regulate a position of the sheet S in the width direction (a transverse direction) which is perpendicular to the sheet feeding direction. The sheet storage 11 further includes slide rails 15 and 15 provided at upstream and downstream sides in the sheet feeding direction.

A sheet trailing edge pressing part 18 is provided above the trailing edge regulating plate 13 which is slidable up and down and rotatable as a pressing member. The trailing edge regulating plate 13 presses the trailing edge of the uppermost sheet Sa to separate the sheets. The sheet trailing edge pressing part 18 also serves as a trailing edge surface detection sensor 18 which is provided in a position of the trailing edge regulating plate 13 facing a sheet surface.

The trailing edge surface detection sensor 18 is disposed in the position of the trailing edge regulating plate 13 facing the sheet surface. The trailing edge surface detection sensor 18 moves along a sheet surface in an arrow I direction (vertical direction) in FIG. 2 and detects a paper surface height when the sheet S is floated by a blowing fan 32.

The sheet storage 11 can be pulled out from the sheet feeding unit 301 by a slide rail 15. If the sheet storage 11 is pulled out to a front side in FIG. 2, the tray 12 descends to a predetermined position to replenish or exchange the sheet. Further, a suction conveyance mechanism 51 of the sheet air-feeding type that separately feeds the sheets S one by one is disposed above the sheet storage 11.

The suction conveyance mechanism 51 includes a suction conveyance part 23, the air blowing unit 29, and a draw roller pair 42. The suction conveyance part 23 draws and conveys the sheet S loaded in the tray 12. The air blowing unit 29 floats and loosens an upper portion of the sheet bundle on the tray to separate the sheets S one by one. The air blowing unit 29 blows the air toward the sheets S supported in the tray 12 to float the sheet.

The suction conveyance part 23 has the suction conveyance belt 21 that rotates in a counter-clockwise direction of FIG. 2 wound around a pair of belt driving rollers 41 and 41. The suction conveyance belt 21 constitutes the suction conveyance member that delivers the drawn sheet S to the draw roller pair 42 at the downstream side in the sheet feeding direction (right direction in FIG. 2) by a conveyance force. Further, the suction conveyance part 23 has a suction fan 36 that generates a negative pressure to draw the sheet S onto the suction conveyance belt 21.

The suction conveyance part 23 is disposed inside the plurality of suction conveyance belts 21 (between the belts) in a front side and in a rear direction of FIG. 2. The suction conveyance part 23 has a long suction duct 34 and an opening portion opening/closing mechanism 28. The suction duct 34 is formed in the front side and -rear direction of FIG. 2 to draw the air through a suction hole (not illustrated) formed in the suction conveyance belt 21. The opening portion opening/closing mechanism 28 opens/closes a part of a suction opening 34*a* formed in the lower part of the suction duct 34. Further, the opening portion opening/closing mechanism 28 has a duct opening/closing member 37 that is disposed in the suction duct 34, turns on/off a negative pressure generating operation in the suction duct 34, and switches the suction operation of the suction conveyance belt 21 between on and off. The suction duct 34 creates a negative pressure space that draws the uppermost sheet by blowing the air in the arrow F direction of FIG. 2 by the suction fan 36. A negative pressure generation part that has a suction opening 34*a* that applies a negative pressure for drawing the sheet to the suction conveyance belt 21 includes the suction duct 34, the suction fan 36, and the duct opening/closing member 37.

The air blowing unit 29 includes a blowing nozzle 33*a* that blows the air from the leading edge to the upper portion of the sheet bundle, a separation nozzle 33*b*, a blowing fan 32, and a blowing/separating duct 33 that sends the air from the blowing fan 32 to the nozzles 33*a* and 33*b*. The air drawn by the blowing fan 32 passes through the blowing/separating duct 33 to blow in the arrow C direction (substantially horizontal direction) by the blowing nozzle 33*a* and floats several sheets among the upper sheets of the sheets S loaded on the tray 12. Further, the air which is drawn by the blowing fan 32 is blown in an arrow D direction by the separation nozzle 33*b* and separates the uppermost sheet Sa of the sheets floated by the blowing nozzle 33*a* from the other sheets to be drawn on the suction conveyance belt 21.

In this configuration, if the user pulls out the sheet storage 11 to the front side of FIG. 2, sets the sheet S, and stores the sheet storage 11 in a predetermined position, a lifter motor 19 (see FIG. 3) is driven to cause the tray 12 to start ascending in the arrow A direction of FIG. 2. The tray is stopped in a position where the distance from the suction conveyance belt 21 is a distance B shown in FIG. 2 to wait for a feeding signal.

The opening portion opening/closing mechanism 28 has a belt guide part 27 and a belt driving roller 203. The belt guide part 27 is disposed near an outer side of the suction opening 34*a* at the downstream side in the sheet feeding direction. The belt driving roller 203 is disposed near the suction opening 34*a* in the belt guide part 27 to advance or retreat the opening portion opening/closing belt 201. Further, the opening portion opening/closing mechanism 28 has an opening portion opening/closing guide 202 that is disposed in approximately a half part of the downstream side in the sheet feeding direction in the suction opening 34*a*.

The opening portion opening/closing belt 201 constitutes a shutter member that is movable between a closing position where the upstream side of the suction opening 34*a* in the sheet feeding direction is partially closed and an opening position where the suction opening 34*a* is opened. Drive of the opening portion opening/closing belt 201 is controlled to close the suction opening 34*a* from the upstream side in the sheet feeding direction.

The opening portion opening/closing guide 202 extends from a left end of the suction opening 34*a* of FIG. 2 to the center thereof. The opening portion opening/closing guide 202 can move in the horizontal direction of FIG. 2 to guide the opening portion opening/closing belt 201 while slidably supporting the front side and the rear side of the opening portion opening/closing belt 201 at two locations of the front side and the rear side of FIG. 2.

A portion which faces the suction opening 34*a* of the belt guide part 27 is in an open state such that it communicates with an opening of the opening portion opening/closing guide 202 at the left edge of FIG. 2. The opening portion opening/closing guide 202 communicates with an opening edge (downstream edge in the sheet feeding direction) of the belt guide part 27 at an outer periphery of the suction opening 34*a* at the belt driving roller 203 side.

The belt driving roller 203 uses a belt driving motor 200 as a driving source and positively or reversely rotates driven by the belt driving motor 200. The belt guide part 27 is configured to have a hollow shape which is bent to have a mountain shape in the vertical direction of FIG. 2 in an inner side of the endless shaped suction conveyance belt 21. In the uppermost portion of the mountain shape in the belt guide part 27, a rotatable support roller 26 that guides a lower surface of the opening portion opening/closing belt 201 is disposed.

The opening portion opening/closing belt 201 is formed to have a belt shape which is not bent in a width direction (the front-rear direction of FIG. 2) orthogonal to the longitudinal direction (the left-right direction of FIG. 2) and has a flexibility in the longitudinal direction. The opening portion opening/closing belt 201 is slidably accommodated in the belt guide part 27 which is disposed in the endless suction conveyance belt 21 and protrudes to the arrow H direction along the opening portion opening/closing guide 202 so as to close the suction opening 34*a* from the upstream side in the sheet conveying direction An entire length of the belt guide part 27 can entirely accommodate the opening portion opening/closing belt 201 in an opening position where the suction opening 34*a* is open. A size of the belt guide part 27 in the front-rear direction in FIG. 2 is equal to a size of the opening portion opening/closing guide 202 in the same direction. The opening portion opening/closing belt 201 is fully pulled out at the center of the suction opening 34*a* by positively rotating the belt driving roller 203 at an upper front edge of the belt guide part 27 and retreated into the belt guide part 27 from the suction opening 34*a* by reversely rotating the belt driving roller 203.

Figure 4A:
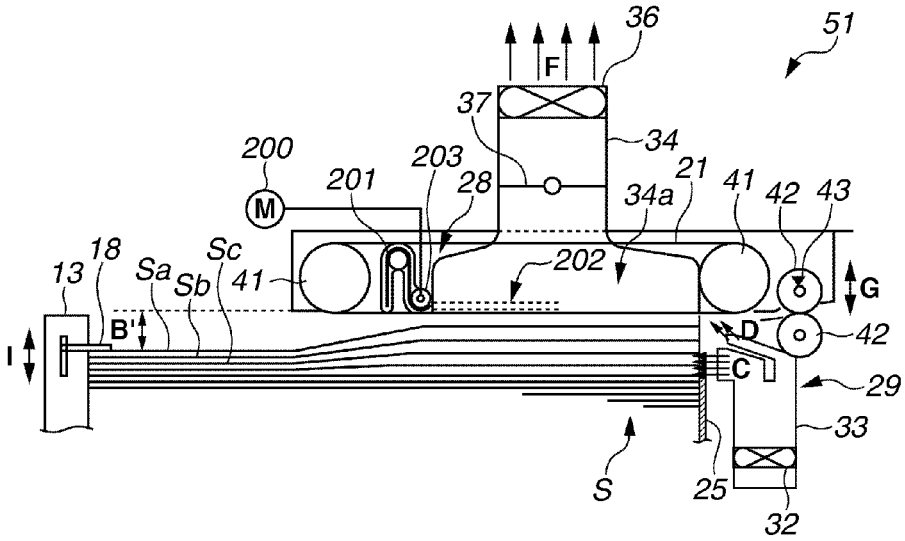
FIGS. 4A and 4B are cross-sectional views illustrating a feeding operation of a suction conveyance unit of the sheet feeding device according to the exemplary embodiment of the present invention.
Figure 4B:
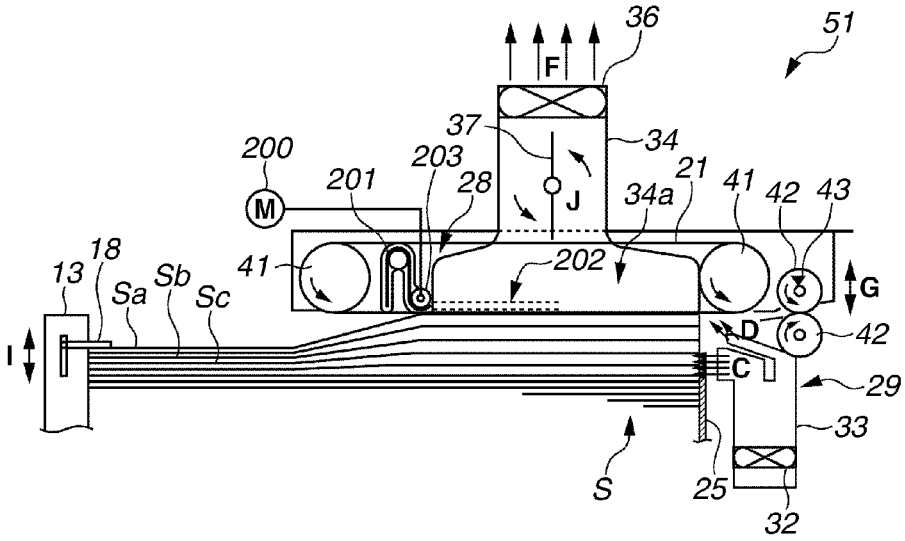
Figure 5A:
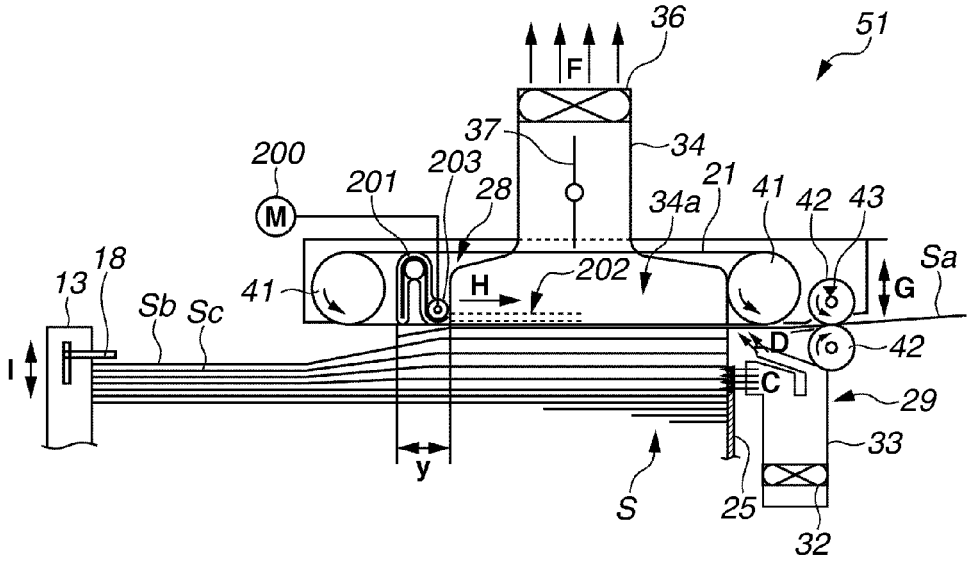
FIGS. 5A and 5B are cross-sectional views illustrating a feeding operation of a suction conveyance unit of the sheet feeding device according to the exemplary embodiment of the present invention.
Figure 5B:
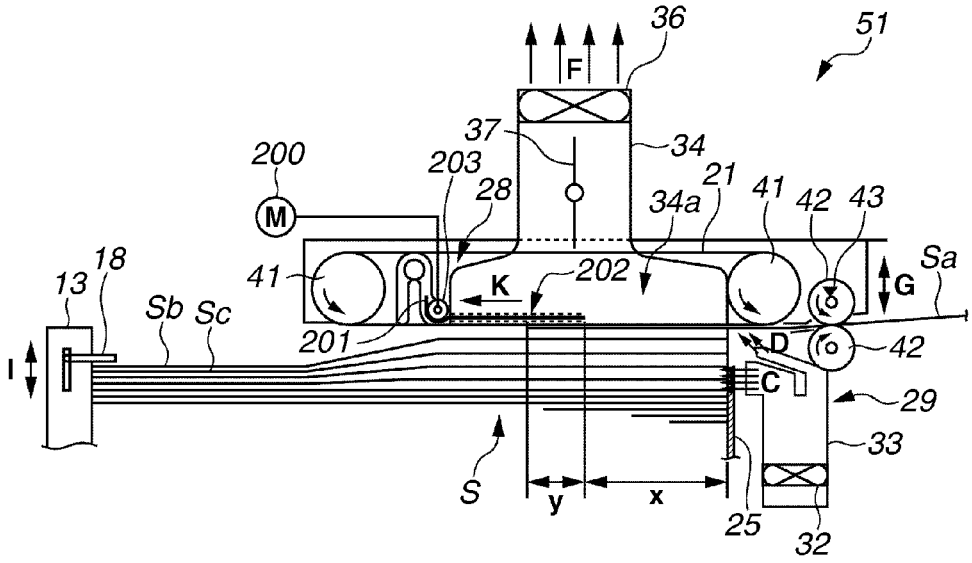

The opening portion opening/closing belt 201 opens the suction opening 34*a* in a state where a portion from the trailing edge to the leading edge is entirely accommodated in the belt guide part 27 (see FIG. 4), and closes approximately a half of the entire suction opening 34*a* in a state where the leading edge is fully advanced toward the suction opening 34*a* (see FIG. 5B).

The draw roller pair 42 which is disposed at the downstream side in the sheet feeding direction of the suction conveyance belt 21 includes a driving roller and a driven roller. The driven roller contacts the driving roller to be rotatably driven. The driven roller operates in an arrow G direction of FIG. 2 according to the thickness of the sheet at the time of passage of the sheet to follow the driving roller.

The displacement sensor 43 is provided above the draw roller pair 42. The displacement sensor 43 detects the amount of displacement from a default position of the pair of the pullout rollers 42. The displacement amount is detected by the displacement sensor 43 according to the thickness of the sheet at the time when one sheet S is conveyed and at the time when two sheets S are conveyed, so that the leading edge and the trailing edge of the overlaid portion of the sheets are detected as the change in the displacement amount. The displacement sensor 43 constitutes a sheet detection part that detects a feeding state of the sheet S which is drawn onto the suction conveyance belt 21 and delivered.

Figure 3:
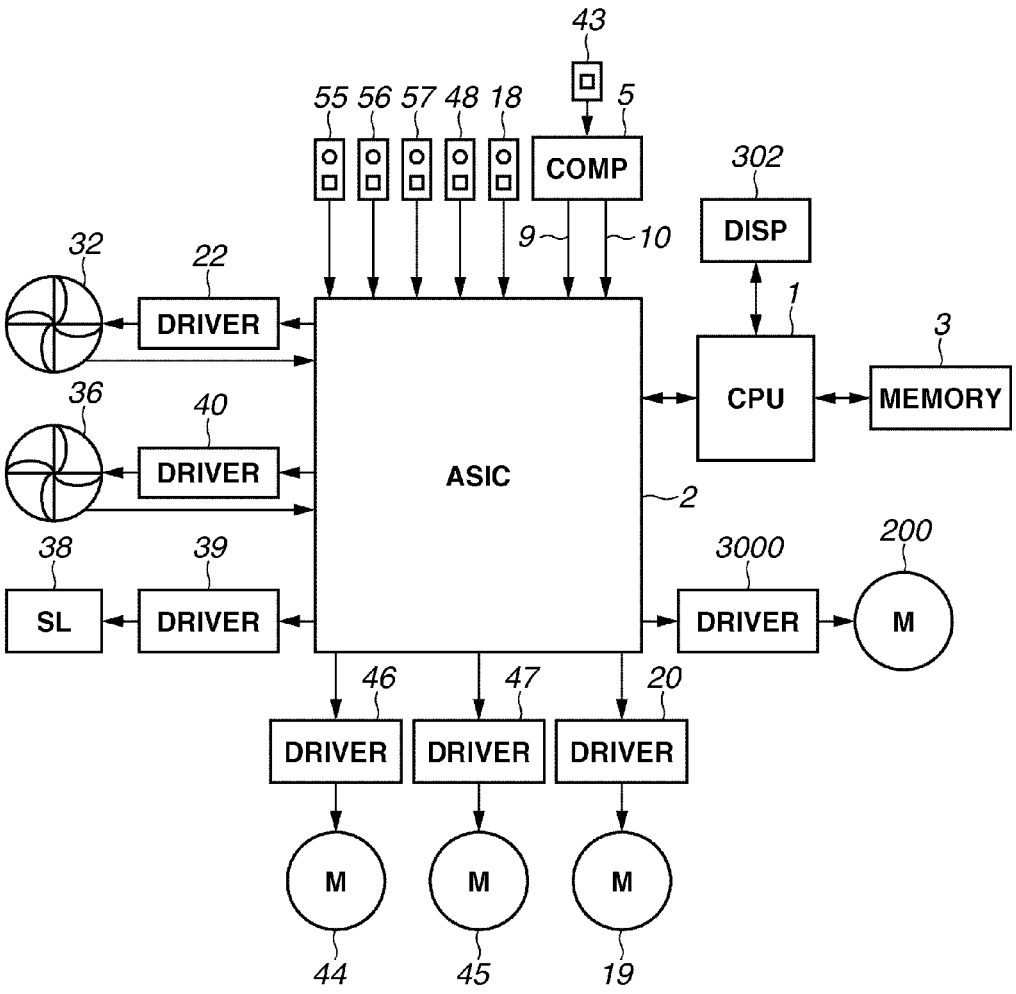
FIG. 3 is a block diagram illustrating a control system of the sheet feeding device according to the exemplary embodiment of the present invention.

Next, referring to FIG. 3, a circuit block in each feeding unit of the sheet feeding devices 311 and 312 of the sheet feeding unit 301 according to an exemplary embodiment of the present invention will be described.

A dedicated ASIC 2 that drives various loads of the sheet feeding device such as a motor or a fan and the manipulation part 302 serving as a setting part which is capable of inputting sheet information such as a size, a grammage, or a surface property of the sheet are connected to a CPU 1 that controls the sheet feeding devices 311 and 312. Further, a storage unit 3 that stores various data input in the manipulation part 302 (see FIG. 1) or a target value or a PWM value which is used to adjust the fan and a COMP converter 5 are connected to the CPU 1.

The CPU 1 constitutes a controlling unit that returns the opening portion opening/closing belt 201 to an opening position at a predetermined timing while closing the suction opening 34*a* following the preceding sheet Sa. The preceding sheet Sa is drawn onto the suction conveyance belt 21 and moves to the downstream side of the feeding direction while the negative pressure generation part is driven. Thus, the controlling unit controls the sheets to be drawn onto the suction conveyance belt 21 in a state where the upstream edge of the preceding sheet Sa in the feeding direction is overlaid with a downstream edge of the subsequent sheet Sb in the feeding direction by a predetermined amount.

The CPU 1 refers to data stored in the storage unit 3 and adjusts a distance B between the suction conveyance belt 21 and the uppermost sheet Sa in the sheet storage 11 (see FIG. 2) according to the sheet information input by the user through the manipulation part 302. Further, the CPU 1 calculates an overlaid amount of the preceding sheet Sa and the subsequent sheet Sb based on the detection result of the displacement sensor 43. A timing of when the suction opening 34*a* is opened from the closed state by the opening portion opening/closing belt 201 is changed based on the calculation result by the CPU 1.

The CPU 1 constitutes a determination part that determines at least one of the sheet information of the size, the grammage, and the surface property of the sheets S loaded on the tray 12. The CPU 1 changes a timing of when the suction opening 34*a* is opened from the closed state by the opening portion opening/closing belt 201 based on the determination result of the determination part. The size, the grammage, and the surface property of the sheets S loaded on the tray 12 may be automatically determined by the CPU (determination part) 1 or determined based on the user setting.

The COMP converter 5 converts and outputs based on a detection waveform of the displacement sensor 43 an output 9 at the time of one sheet and an output 10 at the time of two sheets according to outputs of the plurality of displacement sensors 43 that detects the movement of the sheet on the conveyance path. The displacement sensor 43 is also provided on the conveyance path following the suction conveyance mechanism 51.

A trailing edge paper surface detection sensor 18 that detects a top surface of the sheet loaded on the tray 12 and a storage opening/closing sensor 48 that detects an opened/closed state of the sheet storage 11 are connected to the ASIC 2. Further, an upper position detecting sensor 57 and a lower position detecting sensor 55 that are positional sensors of the tray 12 in the sheet storage 11 and a sheet presence detecting sensor 56 that detects the presence of the sheet on the tray 12 are connected to the ASIC 2. The ASIC 2 monitors outputs of the sensors.

The ASIC 2 not only issues a driving start instruction to a driving circuit that drives loads of the sheet feeding device, but also receives rotational frequency signals (FGs) of the blowing fan 32 and the suction fan 36 and performs the PWM control to rotate the fans 32 and 36 at a target rotational frequency.

A blowing fan driving circuit 22 that transmits a PWM signal output from the ASIC 2 and supplies power to the blowing fan 32 is connected to the ASIC 2. Further, a suction fan driving circuit 40 that transmits a PWM signal output from the ASIC 2 and supplies power to the suction fan 36 is connected to the ASIC 2. A driving circuit 39 that drives a suction solenoid 38 that opens/closes a duct opening/closing member 37 in the suction duct 34 is connected to the ASIC 2.

A driving circuit 46 that drives a feeding motor 44 that drives the belt driving roller 41 and a driving circuit 20 that drives the lifter motor 19 that elevates the tray 12 are connected to the ASIC 2. Further, a driving circuit 47 that drives a pullout motor 45 that drives the draw roller pair 42 and a driving circuit 3000 that drives a belt driving motor 200 that rotatably drives a belt driving roller 203 are connected to the ASIC 2.

The feeding motor 44, the pullout motor 45, and the belt driving motor 200 are pulse motors and control the conveyance over a predetermined distance by the corresponding driving circuits 46, 47, and 3000 according to an amount of pulses supplied from the ASIC 2 based on the control of the CPU 1. The ASIC 2 counts the amount of the pulses to control the amount of movement of the suction conveyance belt 21, the draw roller pair 42, and the opening portion opening/closing belt 201 based on the rotational amounts of the motors.

In the sheet feeding devices 311 and 312 according to an exemplary embodiment of the present invention, various loads of the sheet feeding device such as the motors or the fans are controlled by the CPU 1 through the dedicated ASIC 2. However, the loads may be directly controlled by the CPU 1 without using the dedicated ASIC 2.

Via the manipulation part (setting part) 302, the sheet information such as the size, the grammage, and the surface property of the sheet is input from the manipulation part (setting part) 302. The storage unit 3 stores such information and data as well as a target value or a PWM value which is used to adjust the fans. In the sheet feeding devices 311 and 312, the storage unit 3 is directly connected to the CPU 1 that controls the sheet feeding devices to be included in the sheet feeding device.

However, the sheet information may be input and stored using a separate device in an image forming system including the sheet feeding device. For example, the manipulation part 302 and the storage unit 3 provided in the image forming apparatus may be used to input and store the sheet information. Further, instead of the sheet information input from the manipulation part 302, sheet information which is automatically recognized within the sheet feeding device may be used.

Next, referring to FIGS. 4A to 6C, the suction conveyance mechanism 51 which is in process of feeding and conveying the overlaid sheet will be described. FIGS. 4A to 6C illustrate a series of sheet feeding operations.

In FIG. 4A, the suction conveyance mechanism 51 is in a state where a JOB is instructed by the user and the feeding operation is started according to sheet request information from the image forming apparatus 300A. Upper sheets Sa, Sb, and Sc among the sheets in the sheet storage 11 are loosened at regular intervals by the blowing air (arrow C) by the air blowing unit 29. Here, the height of the sheets is managed to stably loosen the upper sheets and an air volume of the blowing air is controlled according to the detected height of the trailing edge surface detection sensor 18 disposed in the trailing edge regulating plate 13.

A separation air in the arrow D direction in FIG. 4A is also controlled to be synchronized with the blowing air (arrow C) by the air blowing unit 29. The suction fan 36 of the suction conveyance mechanism 51 starts driving following the driving of the blowing fan 32 and discharges the suction air in the arrow F direction in FIG. 4A. The duct opening/closing member 37 closes the suction opening 34*a* as illustrated in FIG. 4A and waits for a predetermined time until the suction fan 36 becomes stable and the sheets are stably loosened by the blowing air. Further, the opening portion opening/closing belt 201 is fully accommodated within the belt guide part 27 and positioned in an outer periphery waiting position of the suction opening 34*a*. In this case, the belt driving roller 41 and the draw roller pair 42 are in a stopped state.

Continuously, in the suction conveyance mechanism 51, after a predetermined time elapses, the duct opening/closing member 37 rotates in the arrow J direction as illustrated in FIG. 4B to generate a negative pressure from the suction opening 34*a* for the sheet. Thus, the uppermost sheet Sa is drawn onto a portion of the suction conveyance belt 21 which faces the suction opening 34*a*. Simultaneously with the rotation of the duct opening/closing member 37 in the arrow J direction, the belt driving roller 41 is driven to start the rotation of the suction conveyance belt 21 in the arrow direction of FIG. 4B and start the rotation of the draw roller pair 42 in the arrow direction of FIG. 4B. Therefore, the uppermost sheet Sa drawn onto the suction conveyance belt 21 is delivered toward the right side of FIG. 4B.

As illustrated in FIG. 5A, the uppermost sheet Sa is continuously conveyed and the opening portion opening/closing belt 201 moves in the arrow H direction of FIG. 5A at a time when a distance between the trailing edge of the uppermost sheet Sa and an outer periphery of the suction opening 34*a* in the upstream side in the conveying direction becomes a distance y. That is, driving of the belt driving motor 200 starts so that the opening portion opening/closing belt 201 protrudes along the opening portion opening/closing guide 202 in the arrow H direction. In this case, a moving speed Vh of the opening portion opening/closing belt 201 in the arrow H direction is equal to a feeding speed Vs of the preceding sheet Sa and controlled to show a relationship of Vh=Vs.

Continuously, the opening portion opening/closing belt 201 moves to protrude in the same direction as illustrated in FIG. 5B. In FIG. 5B, x is a distance from an outer periphery of the suction opening 34*a* in the downstream side in the conveying direction and is a value corresponding to the overlaid amount of the preceding sheet Sa and the subsequent sheet Sb. The distance x corresponds to 50% of the opening surface of the suction opening 34*a* and the suction conveyance belt 21 and the opening portion opening/closing belt 201 move to the position of the distance x at the same speed and maintain the speed relationship of Vh=Vs. In this case, a distance between the trailing edge of the uppermost sheet Sa and the leading edge of the opening portion opening/closing belt 201 is y.

The opening portion opening/closing belt 201 temporally stops at a position x in FIG. 5B, and then returns to the arrow K direction in FIG. 5B when the belt driving motor 200 reversely drives the belt. In this case, the returning speed is defined by Vk.

Figure 6A:
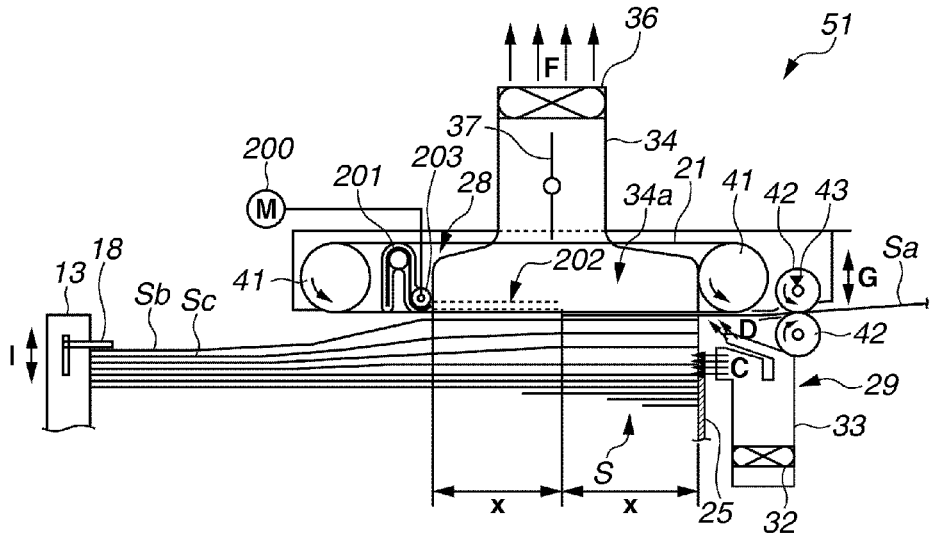
FIGS. 6A to 6C are cross-sectional views illustrating a feeding operation of a suction conveyance unit of the sheet feeding device according to the exemplary embodiment of the present invention.

Next, as illustrated in FIG. 6A, the trailing edge of the uppermost sheet Sa which is continuously delivered is conveyed by a distance corresponding to y to the position of x. In the meantime, the opening portion opening/closing belt 201 returns to the outer periphery of the suction opening 34*a* at a movement speed Vk, where all of the opening portion opening/closing belt 201 including the leading edge is accommodated within the belt guide part 27. Here, the relationship of the movement speed Vk and the feeding speed Vs is defined by x/Vk=y/Vs.

The opening portion opening/closing belt 201 returns to the outer periphery of the suction opening 34*a* to be in an open position, so that the suction opening 34*a* is opened to the sheet Sb which is subsequent to the uppermost sheet Sa and a negative pressure is applied to the sheet Sb. Thus, a portion of the trailing edge of the uppermost sheet Sa corresponding to the distance x, and a portion of the subsequent sheet Sb corresponding to a distance x from a leading edge of the subsequent sheet Sb which abuts on the leading edge regulating plate 25 by the distance x from the upstream side to the outer periphery of the suction opening 34*a* are simultaneously drawn onto the suction conveyance belt 21. Therefore, as illustrated in FIG. 6A, both sheets are delivered.

Figure 6B:
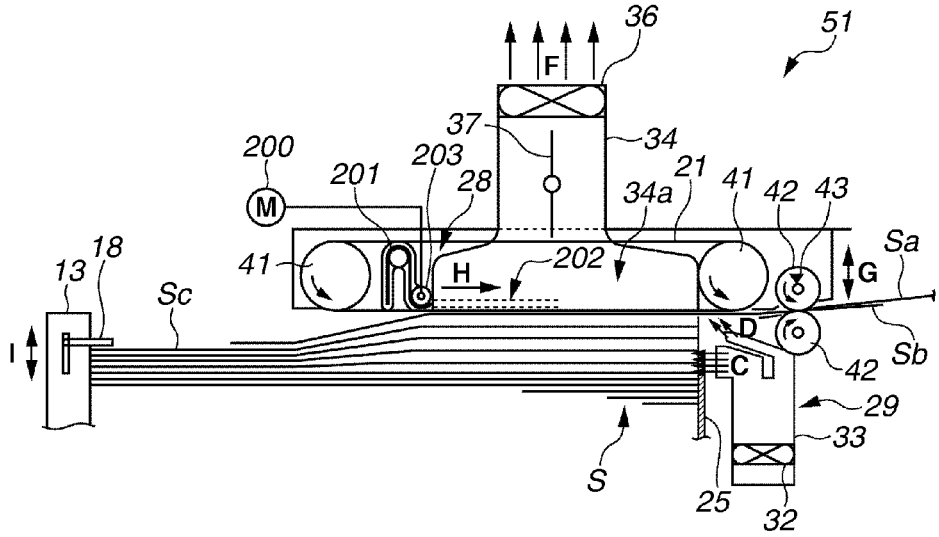

As illustrated in FIG. 6B, the preceding sheet Sa and the immediately subsequent sheet Sb are partially overlaid and delivered through the suction conveyance belt 21 and the draw roller pair 42 to be continuously conveyed to the downstream conveyance roller.

Figure 6C:
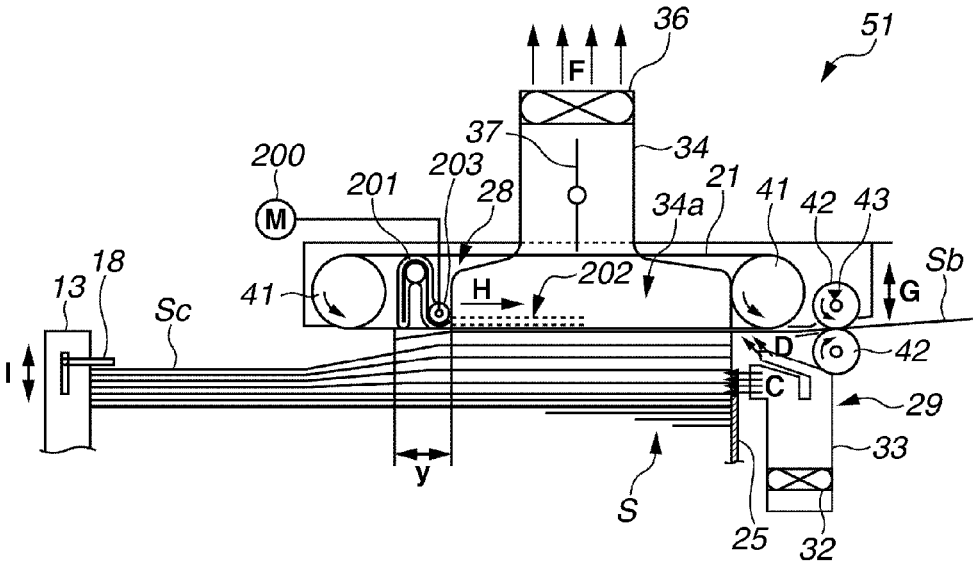

Finally, as illustrated in FIG. 6C, the positional relationship of the sheet Sb (preceding sheet in this case) and a subsequent sheet Sc is substantially similar to the positional relationship illustrated in FIG. 5A. Therefore, the continuous sheet feeding operations from FIG. 5A to FIG. 6B are repeated. Therefore, the sheet feeding conveyance operation in an imbricate state where the sheets are partially overlaid is continuously performed.

Figure 7:
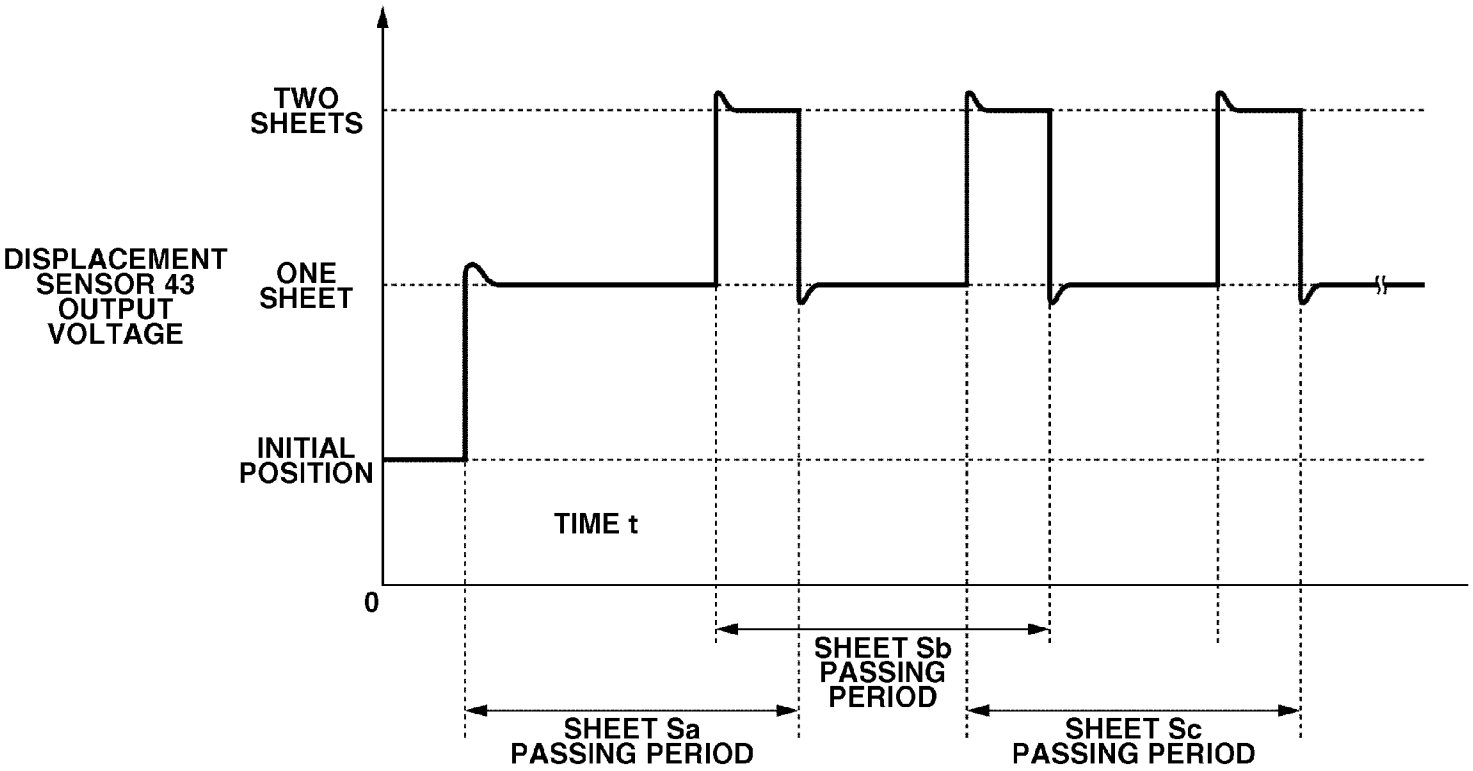
FIG. 7 is a timing chart illustrating an example of a detection waveform from a displacement sensor of the sheet feeding device according to the exemplary embodiment of the present invention.

FIGS. 5A to 6C illustrate a series of imbricate feeding conveyance operations and the detection waveform of the displacement sensor 43 in the draw roller pair 42 is as illustrated in FIG. 7. FIG. 7 is a timing chart illustrating an example of a detection waveform by the displacement sensor 43 in the sheet feeding device.

In this timing chart, in the horizontal axis, as passing periods of the sheets, a passing period of the uppermost sheet Sa, a passing period of the subsequent sheet Sb, and a passing period of another subsequent sheet Sc are represented. Further, in the vertical axis, output voltages at an initial position, at a time when the sheet is one, and at a time when the sheets are two are represented as an output voltage of the displacement sensor 43.

That is, as known from the waveform example of FIG. 7, a portion where one sheet of each of the uppermost sheet Sa, the subsequent sheet Sb, and the other subsequent sheet Sc is fed, a portion where two overlaid sheets are fed, and their changing points are detected.

A plurality of displacement sensors 43 which is provided on the conveyance path following the suction conveyance mechanism 51 also monitors the sheet conveyance state. Hereinafter, a leading edge position and a trailing edge position of another subsequent sheet are similarly detected to monitor the sheet feeding state and detect the abnormal sheet feeding.

Figure 8:
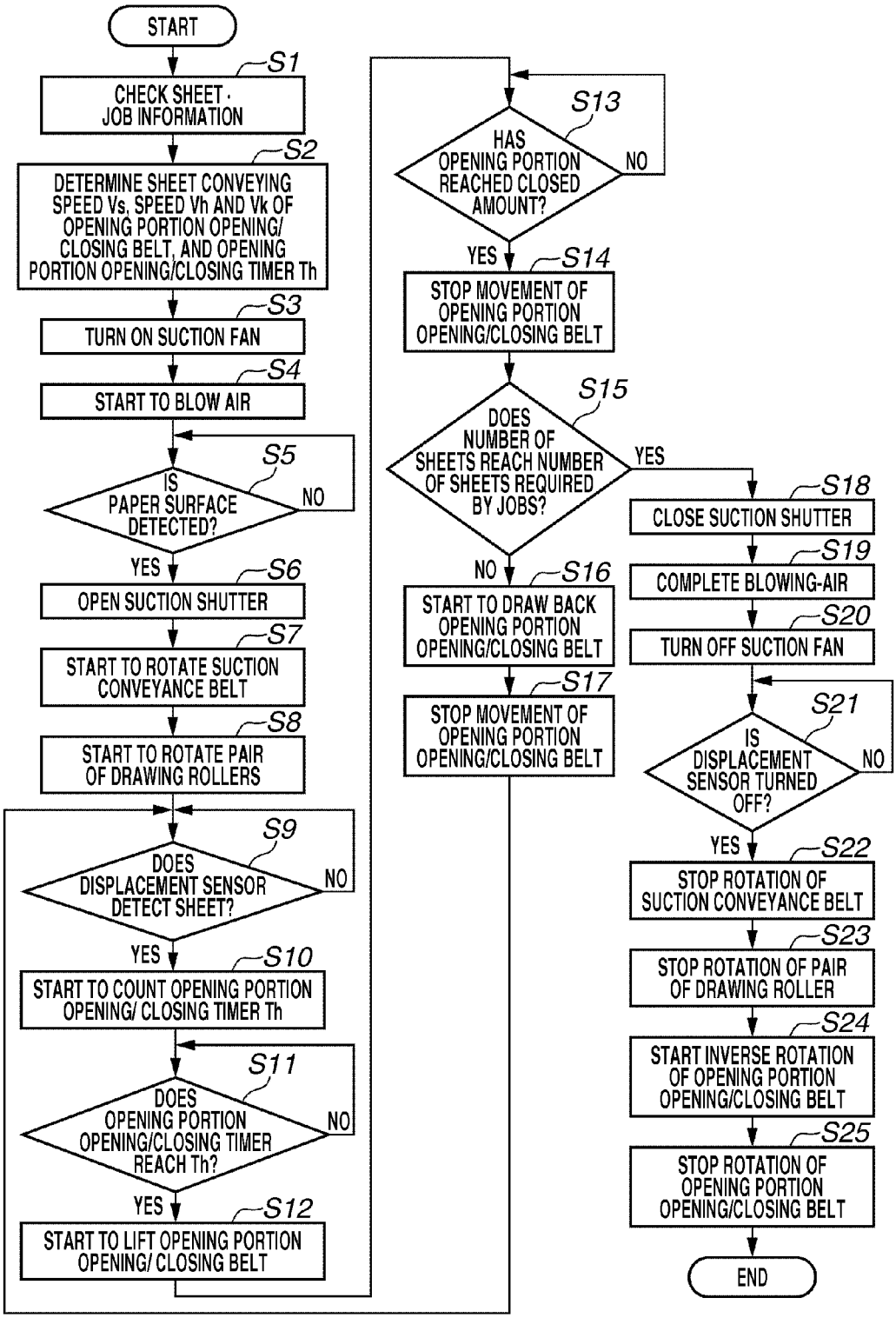
FIG. 8 is a flowchart illustrating an operation of a sheet feeding device according to a first exemplary embodiment of the present invention.

Next, referring to FIG. 8, control of the overlaid sheet feeding/conveyance by the CPU 1 according to the exemplary embodiment of the present invention will be described. However, this description is made by appropriately referring to the state of the suction conveyance mechanism 51 during the feeding operation in FIGS. 2, 4A to 6C. FIG. 8 is a flowchart illustrating an operation of the sheet feeding device according to the exemplary embodiment.

The various sheet information (size, grammage, surface property) stored in the tray 12 by the user is input and set through the manipulation part 302 by the user to be stored in the storage unit 3. A flow starts when the tray 12 is lifted in the arrow A direction of FIG. 2 by the lifter motor 19 and stops in a position where the distance between the suction conveyance belt 21 and the uppermost sheet Sa is B, to wait for the feeding signal.

First, in step S1, if the CPU 1 receives the feeding signal, the CPU 1 refers to the sheet information (sheet and JOB information) of a target feeding unit from the storage unit 3. In step S2, the CPU 1 determines the feeding speed (sheet conveying speed) Vs according to the referenced sheet information, and further determines the movement speeds Vh and Vk which are opening/closing speeds of the opening portion opening/closing belt 201 and an opening portion opening/closing timer Th based on the feeding speed Vs.

The feeding speed Vs varies depending on the surface property or the grammage of the sheet. For example, if a sheet conveying speed of a general sheet which is a high-quality paper (whose grammage is 80 g/m$^2$) is V1, the speed may be reduced to V1×50% in a case of a thick paper that is a high-quality paper (whose grammage is 200 g/m$^2$). Further, in a case of a coated paper whose sheet surface is processed like a coated paper (whose grammage is 200 g/m$^2$), the speed is reduced to V1×33%. This value is determined by the result of study in the image forming apparatus 300A in advance and stored in the storage unit 3 in advance.

The movement speeds Vh and Vk of the opening portion opening/closing belt 201 according to the above value are described with reference to FIGS. 4A to 6C.

The opening portion opening/closing timer Th is calculated based on a length S of the sheet size of the sheet information in the conveying direction and calculated and determined by the following equation:

$$Th=\{S-(2x+y+z)\}/Vs$$

In this equation, z indicates a conveyance distance from the outer periphery of the suction opening 34*a* in FIG. 2 to a detection position of the displacement sensor 43 disposed in the draw roller pair 42.

Next, in step S3, the CPU 1 inputs a control signal into the suction fan driving circuit 40 in the target feeding unit to drive the suction fan 36. Similarly, in step S4, the CPU 1 inputs a control signal to the blowing fan driving circuit 22 and drives the blowing fan 32 to start to blow the air.

In step S5, the CPU 1 waits for a predetermined time until the distance between the surface position of the uppermost sheet Sa and the suction conveyance belt 21 is a B' position of FIG. 4A by the air blowing and the stable surface position is detected by the trailing edge paper surface detection sensor 18. The state of the suction conveyance mechanism 51 at this time is as illustrated in FIG. 4A.

Continuously, the CPU 1 inputs a control signal to the suction solenoid driving circuit 39 to drive the suction solenoid 38 after a predetermined time has elapsed. Thus, in step S6, the duct opening/closing member 37 in the suction duct 34 rotates in the arrow J direction of FIG. 4B to open the duct opening/closing member 37, that is, the suction opening 34*a* is opened in step S7 and the uppermost sheet Sa is drawn by the drawing force in the arrow F direction of FIG. 4. After opening the duct opening/closing member 37, in step S7, the CPU 1 inputs a control signal to the driving circuit 46 to drive the feeding motor 44 and rotates the belt driving roller 41 in the arrow direction of FIG. 4B and rotates the suction conveyance belt 21 in the same direction.

Next, in step S8, the CPU 1 inputs a control signal to the pullout motor driving circuit 47 to drive the pullout motor 45 and rotate the draw roller pair 42 in the arrow direction of FIG. 4B, similar to the belt driving roller 41. In steps S7 and S8, the sheet Sa is conveyed to the draw roller pair 42.

The displacement sensor 43 that is disposed at a driven roller side of the draw roller pair 42 is configured to detect the leading edge and the trailing edge of the sheet which is being conveyed by the draw roller pair 42, from the position of the roller which is displaced according to the thickness of the sheet. In step S9, the CPU 1 waits until the displacement sensor 43 detects the leading edge of the sheet.

In step S10, if the leading edge of the sheet is detected by the displacement sensor 43, the CPU 1 starts to count the opening portion opening/closing timer Th determined in step S2. In step S11, the sheet Sa is continuously fed and conveyed by the suction conveyance belt 21 and the draw roller pair 42 until the opening portion opening/closing timer Th reaches the Th determined in step S2. In other words, in step S11, the opening portion opening/closing timer Th is continuously counted up and the CPU 1 waits until the timer reaches Th. The state of the suction conveyance mechanism 51 at this time is as illustrated in FIG. 5A.

At the time when the count value of the opening portion opening/closing timer Th reaches Th, the CPU 1 determines that the sheet reaching position is in a state illustrated in FIG. 5A. In step S12, in order to protrude the opening portion opening/closing belt 201 from the initial position of the outer periphery of the suction opening 34*a* at a speed Vh, the CPU 1 control the driving circuit 3000 through the ASIC 2 to positively rotate the belt driving motor 200 at a predetermined speed. In this case, in step S13, the amount of pulses which are applied to the belt driving motor 200 is controlled so that the amount of protruded opening portion opening/closing belt 201 reaches a target value illustrated in FIG. 5B.

In step S14, at a timing of when the amount of the protruded opening portion opening/closing belt 201 reaches a position (closed position) illustrated in FIG. 5B, the belt driving motor 200 is stopped and the movement of the opening portion opening/closing belt 201 is temporally stopped. Here, it is checked whether the number of suction-conveyed sheets has reached the number of sheets requested by the JOB. If the number of sheets has not reached the number of sheets requested by the JOB (No in step S15), the CPU 1 proceeds to step S16. If the number of sheets has reached the number of sheets requested by the JOB (Yes in step S15), the CPU 1 proceeds to step S18.

If the number of sheets has not reached the number of sheets requested by the JOB, in order to draw and convey the subsequent sheet Sb, in step S16, the CPU 1 reversely rotates the belt driving motor 200 at a predetermined speed to return the opening portion opening/closing belt 201 which is temporally stopped to an initial position (open position) of the outer periphery of the suction opening 34*a* at the movement speed Vk. In this case, the amount of pulses which are applied to the belt driving motor 200 is controlled so that the opening portion opening/closing belt 201 reaches an initial position illustrated in FIG. 6A from FIG. 5B as a target value.

In step S17, the opening portion opening/closing belt 201 stops the movement at a timing of when the opening portion opening/closing belt 201 is in a state illustrated in FIG. 6A. During transition in the flow from step S16 to S17, the suction opening 34*a* is opened for the subsequent sheet Sb and the sheet Sb is drawn onto the suction conveyance belt 21 to be fed and conveyed.

As described above, by using the opening portion opening/closing belt which follows the preceding sheet, the CPU (controlling unit) 1 closes the suction opening 34*a*, which is opened when the preceding sheet is drawn onto the suction conveyance belt 21 to move to the downstream side of the feeding direction, based on the detection of the preceding sheet by the displacement sensor 43. Thereafter, at a predetermined timing before the opening portion opening/closing belt 201 is separated from the preceding sheet, the CPU 1 controls the opening portion opening/closing belt 201 to move to an open position.

When the edge of the preceding sheet in the downstream side in the feeding direction is detected by the displacement sensor 43, the CPU 1 moves the opening portion opening/closing belt 201 to a closing position at a predetermined closing timing to close the suction opening 34*a* through which the preceding sheet has passed. Therefore, the CPU 1 moves the opening portion opening/closing belt 201 to an open position at a predetermined timing while closing the suction opening 34*a*. The CPU (controlling unit) 1 sets a closing timing and a predetermined timing based on the input sheet information and moves the opening portion opening/closing belt 201 according to the closing timing and the predetermined timing to adjust a predetermined overlaid amount.

While the opening portion opening/closing belt 201 is turning back to stop, the movement amount of the preceding sheet Sa which is conveyed by the suction conveyance belt 21 corresponds to the distance y as illustrated in FIG. 5B. Accordingly, in a state where the trailing edge of the preceding sheet Sa and the leading edge of the subsequent sheet Sb are overlaid by the distance x, the sheets are drawn and conveyed. The state of the suction conveyance mechanism 51 at this time is as illustrated in FIG. 6A.

The preceding sheet Sa and the subsequent sheet Sb are conveyed until the preceding sheet Sa and the subsequent sheet Sb partially overlaid are in a state illustrated in FIG. 6B and the leading edge of the subsequent sheet Sb is detected by the draw roller pair 42. The flow returns to step S9 and is repeated until the processing of the number of sheets requested by the JOB is completed.

Returning to step S15, a case when the processing of the number of sheets has reached the number of sheets requested by the JOB will be described.

In step S14, after stopping the protruding of the opening portion opening/closing belt 201, if it is determined that the number of sheets reaches the number of sheets requested by the JOB (Yes in step S15), the CPU inputs a control signal to the suction solenoid driving circuit 39 to drive the suction solenoid 38. By doing this, in step S18, the CPU 1 rotates the duct opening/closing member 37 in the suction duct 34 in a direction opposite to the arrow J direction of FIG. 4B to close the suction opening 34*a*.

Continuously, in step S19, the CPU 1 inputs a control signal to the blowing fan driving circuit 22 and stops the blowing fan 32 to stop blowing the air. Similarly, in step S20, the CPU inputs a control signal to the suction fan driving circuit 40 and stops the suction fan 36. In step S21, the CPU 1 waits until the displacement sensor 43 detects the trailing edge of the last conveyed sheet of the number requested by the JOB.

Continuously, in step S22, when the displacement sensor 43 detects the trailing edge of the sheet, the CPU 1 inputs a control signal to the driving circuit 46 to stop the feeding motor 44 and stops the belt driving roller 41 that drives the suction conveyance belt 21.

In step S23, the CPU 1 inputs a control signal to the pullout motor driving circuit 47 to stop the pullout motor 45 and also stop the draw roller pair 42. Further, in step S24, the CPU 1 inputs a control signal to the driving circuit 3000 to inversely drive the belt driving motor 200 and move back the opening portion opening/closing belt 201 from a protruded position (open position) to an initial position (closing position). In step S25, the CPU 1 stops the belt driving motor 200 after completely returning the opening portion opening/closing belt 201 to the initial position and completes the processing flow.

In the above-described exemplary embodiment, the overlaid amount of the preceding sheet and the subsequent sheet at the time of suction conveyance is adjusted by the CPU 1 at a timing of when the opening portion opening/closing belt 201 opens the suction opening 34*a* from the closed state soon after the displacement sensor 43 detects the leading edge of the preceding sheet. Therefore, the opening portion opening/closing belt 201 is driven to switch the suction opening 34*a* between the closing position and the open position with a simple configuration. Therefore, it is possible to draw and convey the sheets in an imbricate with a stable overlaid amount.

In other words, based on the timing corresponding to the preceding sheet Sa which is being conveyed, the opening portion opening/closing belt 201 at the open position simply returns from the temporal closing position to the open position so that the overlaid sheets may be fed with a stable overlaid amount. Therefore, it is possible to lower the feeding speed and improve the sheet conveyance efficiency without lowering the sheet productivity.

Thus, even in the image forming apparatus having a comparatively short sheet conveyance path from the position of the tray 12 to the image forming position, the sheet may be overlaid to start the conveyance from the suction conveyance unit (suction conveyance part). Therefore, it is possible to achieve high productivity while lowering the feeding speed. As a result, it is possible to feed and convey the sheet with a low power consumption and a low operation noise.

Next, a second exemplary embodiment of the present invention will be described in detail with reference to FIG. 9 which is a flowchart of an operation under the control of the CPU 1.

An image forming system according to the secondary exemplary embodiment has a similar schematic configuration to the configuration of the first exemplary embodiment illustrated in FIG. 1. Therefore, the description of the second exemplary embodiment will be omitted. Further, a brief configuration of sheet feeding devices 311 and 312 and a circuit block configuration view of feeding units in the sheet feeding devices 311 and 312 according to the second exemplary embodiment are similar to the configuration of the first exemplary embodiment illustrated in FIGS. 2 and 3. Therefore, the description thereof will be omitted.

Figures 9, 9A:
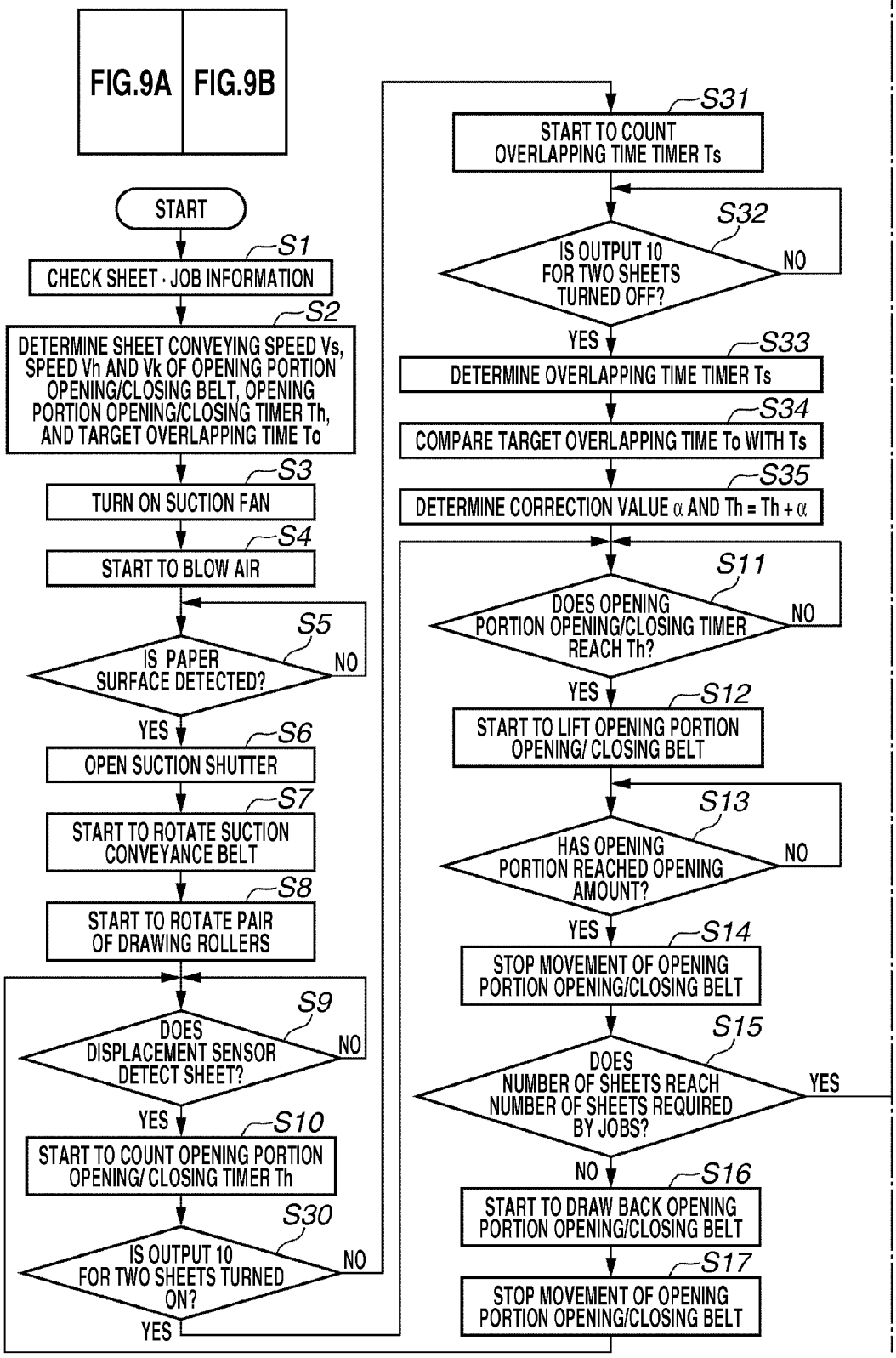
FIG. 9 is a flowchart illustrating an operation of a sheet feeding device according to a second exemplary embodiment of the present invention.
Figure 9B:
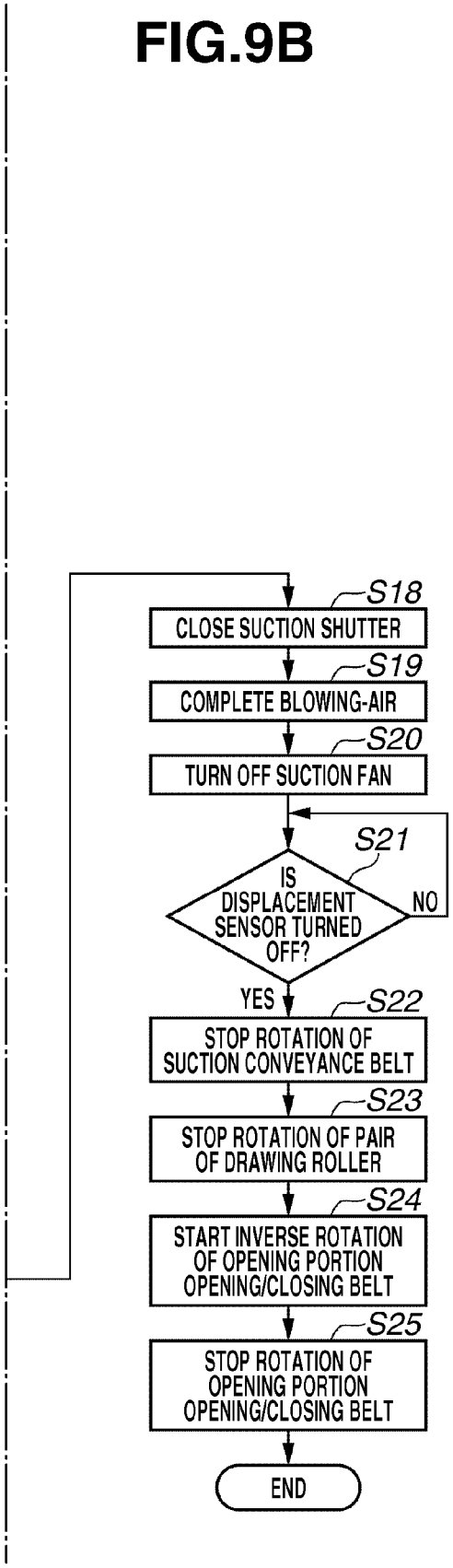

Here, steps S1 to S10 and S11 to S25 of FIG. 9 in this exemplary embodiment are substantially similar to the steps according to the first exemplary embodiment in FIG. 8 (step S2 is slightly different). To the flow of FIG. 9, steps S30 to S35 are added. Therefore, in this exemplary embodiment, steps S30 to S35 will be mainly described.

Specifically, in step S2, the CPU 1 determines the feeding speed (sheet conveying speed) Vs, movement speeds Vh and Vk which are opening speeds of the opening portion opening/closing belt 201, an opening portion opening/closing timer Th, and a target overlapping time To based on sheet•JOB information obtained in step S1. The feeding speed Vs, the movement speeds Vh and Vk, and the opening portion opening/closing timer Th are the same as described in the first exemplary embodiment.

The target overlapping time refers to a time corresponding to the overlaid amount of the trailing edge of the preceding sheet and the leading edge of the subsequent sheet. In this exemplary embodiment, the target overlapping time is set to correspond to the overlaid amount of 50 mm. Steps S3 to S10 are similar to those in the first exemplary embodiment and thus the description thereof will be omitted.

Continuously, in step S10, if the leading edge of the sheet is detected by the displacement sensor 43, the CPU 1 starts to count the opening portion opening/closing timer Th determined in step S2. The output 9 for one sheet and the output 10 for two sheets of the COMP converter 5 that converts the output of the displacement sensor 43 are input to the ASIC 2 and the output results are monitored by the CPU 1.

When the displacement by the leading edge of the sheet is detected by the displacement sensor 43 in step S10, if the displacement is the change point (referred to as ON) of the output 10 for two sheets from one sheet to two sheets (Yes in step S30), in step S31, the CPU 1 starts to count an overlapping time timer Ts. In step S32, the CPU 1 waits until the change point (referred to as OFF) of the output 10 for two sheets from two sheets to one sheet is detected.

The CPU 1 stops counting the overlapping time timer Ts at a timing of when OFF of the output 10 for two sheets is detected and determines the overlapping time timer Ts. After determining the overlapping time timer Ts, in step S33, the CPU 1 stores the determined Ts value in the storage unit 3 and then clears the overlapping time timer Ts to be 0. The determined overlapping time timer Tx is an overlapping time corresponding to a distance and a time corresponding to an amount of overlaid sheets when the sheets are actually conveyed. In order to compare the determined overlapping time timer Tx with a target overlapping time To, in step S34, the CPU 1 reads the overlapping time timer from the storage unit 3 to compare the overlapping time timer with the target overlapping time. The comparison is performed as follows:

$\alpha=(To-Ts)$, and a correction value $\alpha$ is determined.

If the correction value $\alpha$ is negative, it indicates that the conveyance of the subsequent sheet is delayed compared with the preceding sheet as to a target sequence and thus the overlaid amount is smaller than a target amount. Further, if the correction value $\alpha$ is positive, it indicates that the conveyance of the subsequent sheet is faster than that of the preceding sheet as to a target sequence and thus the overlaid amount is larger than the target amount.

The correction value $\alpha$ is determined and then stored in a predetermined address area of the storage unit 3. In step S35, the CPU 1 adds the correction value $\alpha$ to the opening portion opening/closing timer Th determined in step S10 to update the corrected opening portion opening/closing timer Th as follows:

$Th=Th+\alpha$. Hereinafter, the flow in step S11 is similar to that in the first exemplary embodiment and thus the description will be omitted.

As described above, the difference of the opening portion opening/closing timer Th from the target value whenever the sheets are fed (every sheet feeding) is detected as the correction value $\alpha$ and the correction value $\alpha$ is added to the opening portion opening/closing timer Th to correct Th. Therefore, a distance y' corresponding to y in FIGS. 5A and 5B in the first exemplary embodiment will be as follows: $y'=y+Vs\times\alpha$. As described above, y' is corrected to appropriately change a suction timing of the subsequent sheet.

Here, if a timing of when the correction value $\alpha=0$ is y, when the correction value $\alpha$ is negative, $y'<y$. Therefore, the suction starting timing of the subsequent sheet becomes earlier so that the overlaid amount is increased by the amount smaller than the target value, which makes a correction to obtain an appropriate amount. In contrast, if $\alpha$ is positive, $y'>y$ and the suction starting timing of the subsequent sheet becomes later so that the overlaid amount is decreased by the amount larger than the target value, which makes a correction to obtain an appropriate amount.

According to the above-described exemplary embodiment, a substantially similar effect to the first exemplary embodiment is obtained. Further, the opening portion opening/closing timing is controlled to maintain the constant overlaid amount between the preceding sheet and the subsequent sheet. Therefore, it is possible to feed the sheets with the more stable overlaid amount of the sheets. Accordingly, it is possible to achieve high productivity while lowering the feeding speed and to feed and convey the sheet with a low power consumption and a low operation noise.

According to this exemplary embodiment, the correction value $\alpha$ is added to the opening portion opening/closing timer Th to correct the opening/closing sequence of the suction opening 34*a*. Further, the suction timing of the subsequent sheet with respect to the preceding sheet is changed to control the overlaid amount between the sheets to be constant. Therefore, if an element that feedbacks the correction value $\alpha$ is reflected to a movement speed Vh when the opening portion opening/closing belt 201 is closed, and a movement speed Vk when the opening portion opening/closing belt 201 is open, the similar effect may be obtained. Further, it is obvious that the similar effect may be obtained even when the feeding speed (sheet conveying speed) Vs is changed.

Further, in this exemplary embodiment, the opening portion opening/closing belt 201 is moved from the upstream side in the conveying direction maintaining a certain distance y from the trailing edge of the preceding sheet Sa while it is synchronized with the feeding speed Vs. However, when the suction opening 34*a* is closed from the direction perpendicular to the conveying direction in an amount equivalent to the suction opening 34*a* closed by the opening portion opening/closing belt 201 illustrated in FIG. 5B or applying of the suction force in a corresponding portion of the suction opening 34*a* is stopped by the shutter, the similar effect may also be obtained. However, this is limited to a case when a degree of the suction force in the corresponding portion of the suction opening 34*a* does not cause stable drawing of the subsequent sheet.

In the first and second exemplary embodiments, an example in which the present invention is applied to the sheet feeding devices 311 and 312 that supply the sheet to the image forming unit is described. However, the present invention is not limited thereto. For example, the present invention may be applied to an inserter. In this case, a sheet on which an image is formed may be supplied to the sheet processing device 304 (sheet processing part) or another sheet may be supplied between sheets which are disposed between the image forming unit and the sheet processing device 304 and conveyed with an image formed thereon by the image forming unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-018449 filed Jan. 31, 2012, which is hereby incorporated by reference herein in its entirety.

What is claimed is:

1. A sheet feeding device, comprising:

an elevatable tray that supports a sheet;

an air blowing unit that blows air toward the sheet supported by the tray to float the sheet;

a suction conveyance member that draws and conveys the sheet floated by driving the air blowing unit;

a negative pressure generation part that has a suction opening that applies a negative pressure for sheet suction to the suction conveyance member;

a shutter member that moves between a closing position where the suction opening in an upstream side in a sheet feeding direction is partially closed and an open position where the suction opening is opened; and a controlling unit that is, in a driving state of the negative pressure generation part, configured to control the shutter member to follow a preceding sheet that is drawn onto the suction conveyance member, to move to a downstream side in the feeding direction to close the suction opening, and return to the open position at a predetermined timing to draw the sheets onto the suction conveyance member in a state where an upstream edge of the preceding sheet in the feeding direction and a downstream edge of a subsequent sheet in the feeding direction are overlaid by a predetermined amount.

2. The sheet feeding device according to claim 1, further comprising:

a sheet detection part that detects a feeding state of a sheet that is drawn onto the suction conveyance member and delivered from the sheet feeding device to a sheet processing part;

wherein the controlling unit moves the shutter member to the open position at the predetermined timing before the shutter member is separated from the preceding sheet after the shutter member following the preceding sheet closes the suction opening that is opened when the preceding sheet is drawn onto the suction conveyance member to move to the downstream side of the feeding direction based on detection of the preceding sheet by the sheet detection part.

3. The sheet feeding device according to claim 2, wherein, when the downstream edge of the preceding sheet in the feeding direction is detected by the sheet detection part, the controlling unit moves the shutter member to the open position at the predetermined timing while moving the shutter member to the closing position to close the suction opening through which the preceding sheet has passed at a predetermined closing timing.

4. The sheet feeding device according to claim 3, wherein the controlling unit sets the closing timing and the predetermined timing based on input sheet information and moves the shutter member according to the closing timing and the predetermined timing to adjust the predetermined amount when the sheets are overlaid.

5. The sheet feeding device according to claim 1, wherein the suction conveyance member is an endless suction conveyance belt, the negative pressure generation part has a suction duct disposed inside the suction conveyance belt and a suction fan that creates negative pressure inside the suction duct, and the suction opening is disposed at a portion of the suction duct facing the suction belt.

6. The sheet feeding device according to claim 1, wherein the shutter member is an opening portion opening/closing belt that is advanced and retreated by a belt driving roller, and the opening portion opening/closing belt moves by being guided by an opening portion opening/closing guide disposed in the suction opening.

7. The sheet feeding device according to claim 6, wherein the opening portion opening/closing belt is movable from an upstream side to a downstream side in the suction opening.

8. An image forming apparatus, comprising:

the sheet feeding device according to claim 1; and a sheet processing part that performs processing on the sheet delivered from the sheet feeding device.

9. The image forming apparatus according to claim 8, wherein the sheet processing part is an image forming unit that forms an image on the sheet.

10. The image forming apparatus according to claim 8, wherein the sheet processing part is a post processing part that performs post processing on the sheet on which an image is formed by an image forming unit.

* * * * *